United States Patent [19]

Ito

[11] Patent Number: 5,016,585

[45] Date of Patent: May 21, 1991

[54] ANTICORROSIVE AND RUST FREE SYSTEM FOR MARINE-USING ENGINE

[75] Inventor: Daisuke Ito, Kochi, Japan

[73] Assignee: Tosa Plastic Zosen Corporation, Kochi, Japan

[21] Appl. No.: 550,088

[22] Filed: Jul. 9, 1990

[30] Foreign Application Priority Data

Mar. 5, 1990 [JP] Japan ..... 2-54489

[51] Int. Cl.[5] ..... F02B 77/00

[52] U.S. Cl. ..... 123/198 E; 204/147

[58] Field of Search ..... 123/198 E; 440/88; 204/147, 148, 196, 197

[56] References Cited

U.S. PATENT DOCUMENTS

| | | | |
|---|---|---|---|
| 2,424,145 | 7/1947 | Butler | 123/198 E |
| 3,081,252 | 3/1963 | Preiser et al. | 204/196 |
| 3,477,930 | 11/1969 | Crites | 204/148 |
| 3,513,082 | 5/1970 | Beer et al. | 204/148 |
| 3,841,988 | 10/1974 | Gleason | 204/147 |
| 4,615,684 | 10/1986 | Kojima | 204/147 |

*Primary Examiner*—Noah P. Kamen

*Attorney, Agent, or Firm*—Shlesinger Arkwright & Garvey

[57] ABSTRACT

An anticorrosive system for preventing marine-using engines comprises an anti-electrolytic corrosive device, including a low potential metal member through which an engine coolant can pass, the device being arranged in the vicinity of a coolant intake port of an engine cooling unit; an electrically connecting unit for connecting between the anti-electrolytic corrosive device and several portions of the engine to generate an anticorrosive current owing to the potential between the low potential metal member and the engine metal, whereby preventing the engine from suffering with electrolytic corrosion and depositing the resolved low potential metal onto the inner surface of the coolant pipe of the engine cooling unit.

8 Claims, 2 Drawing Sheets

ANTICORROSIVE AND RUST FREE SYSTEM FOR MARINE-USING ENGINE

BACKGROUND OF THE INVENTION

1. Field of the Invention

The present invention generally relates to an anticorrosive device and its using system for preventing marine-using engines from suffering with electrolytic corrosion and rust. More particularly, the present invention relates to an anticorrosive device adapted for marine-using engines mounted on various ships and boats, which use sea water as the their engine coolant.

2. Description of the Prior Art

Many conventional marine-using engines mounted on various ships and boats, which use sea water as their engine coolant, have tended to be suffered with electrolytic corrosion by sea water. Thus the life-time of such type engines may be generally shorter than their inherent life-time on account of the electrolytic corrosion. In order to overcome such problem, conventional marine-using engines have anticorrosive means for preventing the electrolytic corrosion including zinc made members in bolt shape or plate shape which are fixed on the external surface of their engines.

In such anticorrosive type marine-using engines, however, a small amount of zinc members are partially fixed and therefore the zinc members should be often supplied because they are consumed in a short period such as 5 to 8 months. In practical scene, many users may forget to supplement them. On the other hand, since the zinc members are partially fixed on the external surface of the engine, the zinc members may limitedly affect their anticorrosive function. Further, such conventional marine-using engines whose external surfaces are fixed with some zinc members can not be provided with sufficient amount of zinc materials to effectively preventing the generation of corrosion.

In addition to the above mentioned problems, the low potential metals such as zinc fixed on the external surface of the conventional anticorrosive engines can only prevent the generation of electrolytic corrosion, but are not possessed of function to prevent the generation of rust and to remove the rust from various portions of the engine. Resolved zinc is directly discharged to the outside of the engine.

BRIEF SUMMARY OF THE INVENTION

It is an object of the present invention to provide an anticorrosive device and its system for preventing marine-using engines from suffering with electrolytic corrosion and rust.

Another object of the present invention is to provide an anticorrosive device and its system which can extend life-time of marine-using engines without complicated maintenance.

Further object of the present invention is to provide an anticorrosive device and its system which can remove generated rust from the engine and apply plating layer thereon.

To accomplish the above objects, the anticorrosive system for marine-using engines according to the present invention comprises an anti-electrolytic corrosive device, including a low potential metal member through which an engine coolant can pass, in the vicinity of a coolant intake port of a coolant pipe; an electrically connecting unit for connecting between the anti-electrolytic corrosive device and several portions of the engine to generate an anticorrosive current owing to the potential between the low potential metal member and the engine metal, whereby preventing the engine from suffering with electrolytic corrosion and depositing the low potential metal resolved onto the inner surface of the coolant pipe.

One aspect of the anticorrosive device for marine-using engines according to the present invention comprises a cylindrical casing including a low potential metal member through which an engine coolant can pass, being arranged in the vicinity of a coolant intake port of a coolant pipe; means for electrically connecting between the cylindrical casing and several portions of the engine, or the cylindrical casing additionally provided with a charger and several portions of the engine; and optionally a fan rotatably provided within the cylindrical casing; and a pump driven by the revolving force output from the fan.

In the above described anticorrosive device according to the present invention, and anticorrosive current is generated by the potential between the low potential metal and the portions of the engine, so that the anticorrosive current can prevent the engine from suffering with electrolytic corrosion. On the same occasion, the resolved low potential metal is deposited on the inner surface of the coolant pipe owing to its plating function. According to this operation, the rust can be removed from the surfaces of the engine and the coolant pipe, and then the rust-removed surfaces are coated with the low potential metal layer as a protection layer. Further, in the case of the anticorrosive unit additionally provided with the charger, current is flowed from the charger to various portions of the engine so that the low potential metal can be accelerately resolved. Therefore the rust can be effectively removed from the inner surface of the coolant pipe and the coating layer can be smoothly deposited thereon. In addition to the anticorrosive effect, the pump is driven by the coolant flow to discharge the sea water collected in the bottom of ship or boat.

Other features and advantages of the invention will be apparent from the following description taken in connection with the accompanying drawing.

DETAILED DESCRIPTION OF THE PREFERRED EMBODIMENT

Preferred embodiments of the anticorrosive device according to the present invention will be described in detail with referring to the accompanying drawings.

Figure 1:
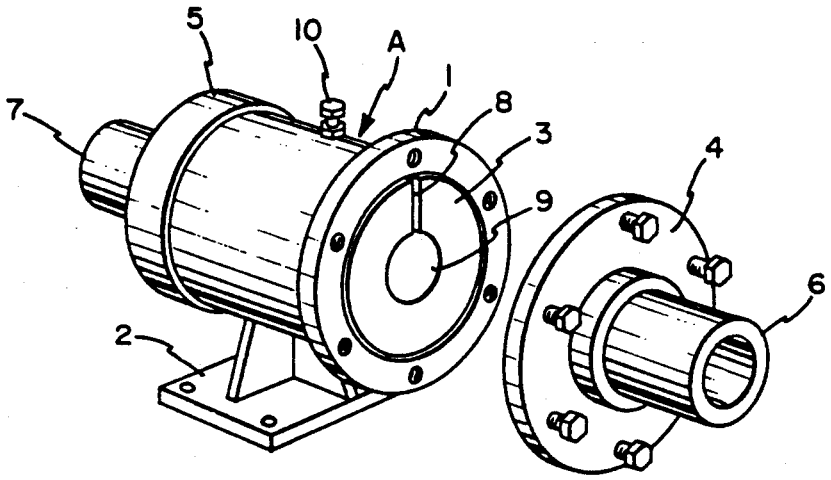
FIG. 1 is an external perspective view showing the first embodiment of the anticorrosive device according to the present invention.

FIG. 1 shows a first embodiment of the anticorrosive device (A) which comprises a cylindrical casing 1 horizontally fixed on a base 2. A low potential metal member 3 in a hollow cylinder shape is set in the cylindrical casing 1. In this embodiment, the low potential metal member 3 is preferably selected from zinc with a high purity or zinc alloy such as Zinnode. The cylindrical casing 1 is provided with two lids 4 and 5 which are detachably fixed on both ends of the casing 1. The lids 4 and 5 are respectively connected to connection pipes 6 and 7. The low potential metal member 3 includes a slit 8 and a through hole 9. The connection pipe 6 is further connected to a sea water intake port and the connection pipe 7 is further connected to an engine cooling system. Sea water intaken through the connection pipe 6 flows through the slit 8 and the through hole 9. The cylindrical casing 1 is further provided with a terminal 10 for connecting an electric wire system.

Figure 2:
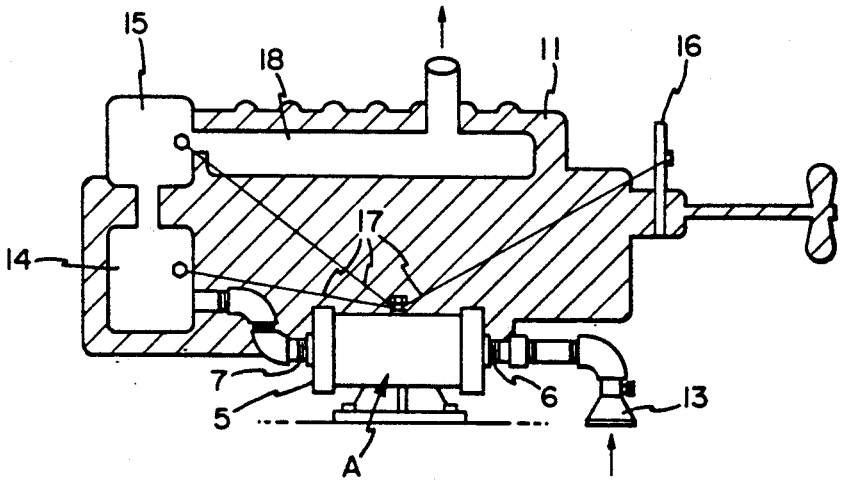
FIG. 2 is a schematic side view showing one example of using state wherein the anticorrosive device shown in FIG. 1 is assembled on a marine-using engine.
Figures 3A, 3B, 3C, 3D:
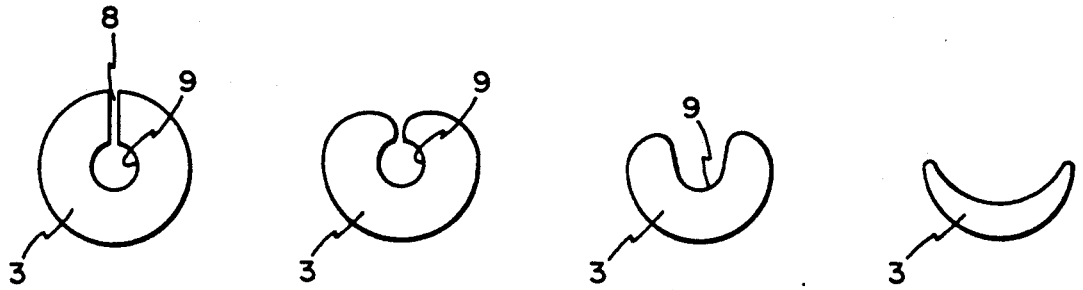
FIG. 3 is a schematic view showing the low potential metal used in the anticorrosive device for explaining its operation.

Such constituted anticorrosive device (A) is assembled on a cooling system, near its sea water intake port, of a marine using engine 11 as shown in FIG. 2. In detail, the connection pipe 6 is connected to a Kingston valve 13 and the connection pipe 7 is connected to a coolant pump 14. The wires 17 are electrically connected between the terminal 10 and engine parts such as the coolant pump 14, a coolant reservoir 15, and a clutch 16.

One typical operation of the above constituted anticorrosive device (A) will be described. As the engine 11 starts and thus the coolant pump 14 is also driven, sea water intaken from the Kingston valve 13 is flowed through the cylindrical casing 1 via the connection pipe 6. The water flowing in the casing 1 is brought into contact with the low potential metal member 3 and then flowed into an exhaust pipe 18 via the connection pipe 7 and the coolant reservoir 15. The water receives the heat from exhaust gas and is finally discharged out of the engine with the exhaust gas. On the same occasion, an anticorrosive current is generated by the potential between the low potential metal member 3 and the portions of the engine, so that the anticorrosive current can prevent the engine from suffering with electrolytic corrosion. Further, the resolved low potential metal member 3 is deposited on the inner surface of the coolant pipe owing to its plating function. According to this operation, the rust can be removed from the surfaces of the engine and the coolant pipe, and then the rust-removed surfaces are coated with the low potential metal layer as a protection layer.

The low potential metal member 3 will be gradually resolved as shown in FIG. 3(A) to FIG. 3(D) for a long period. The corrosion is started from the slit 8 and finally the low potential metal member 3 is completely disappeared without obstructing the water passage.

Figure 4:
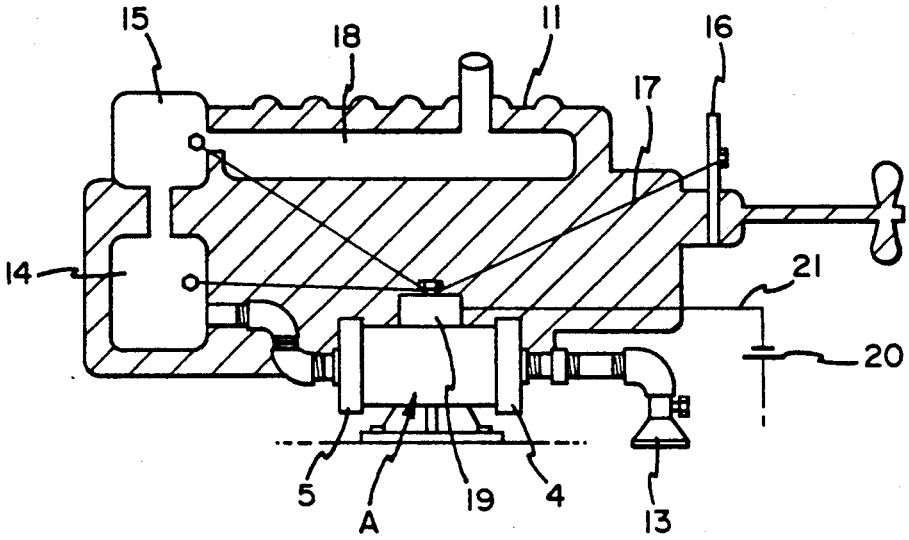
FIG. 4 is a schematic side view showing another example of using state wherein the second embodiment of the anticorrosive device is assembled on a marine-using engine.

FIG. 4 shows the second embodiment of the anticorrosive device which is additionally provided with a charger 19 on the cylindrical casing 1. The charger 19 is electrically connected to a power source 20 such as a battery through a wire 21 and further connected to various portions of the engine such as the coolant pump 14, the coolant reservoir 15 and the clutch 16 through the wires 17. According to this wire system, the charged current is supplied from the battery to the various portions of the engine, so that the low potential metal member 3 in the anticorrosive device (A) can be accelerately resolved. Therefore the rust can be effectively removed from the inner surface of the coolant pipe and the coating layer can be smoothly deposited thereon. The charger 19 may be optionally provided with a timer, not shown, to properly adjust the resolving time of the low potential metal member 3.

Figure 5:
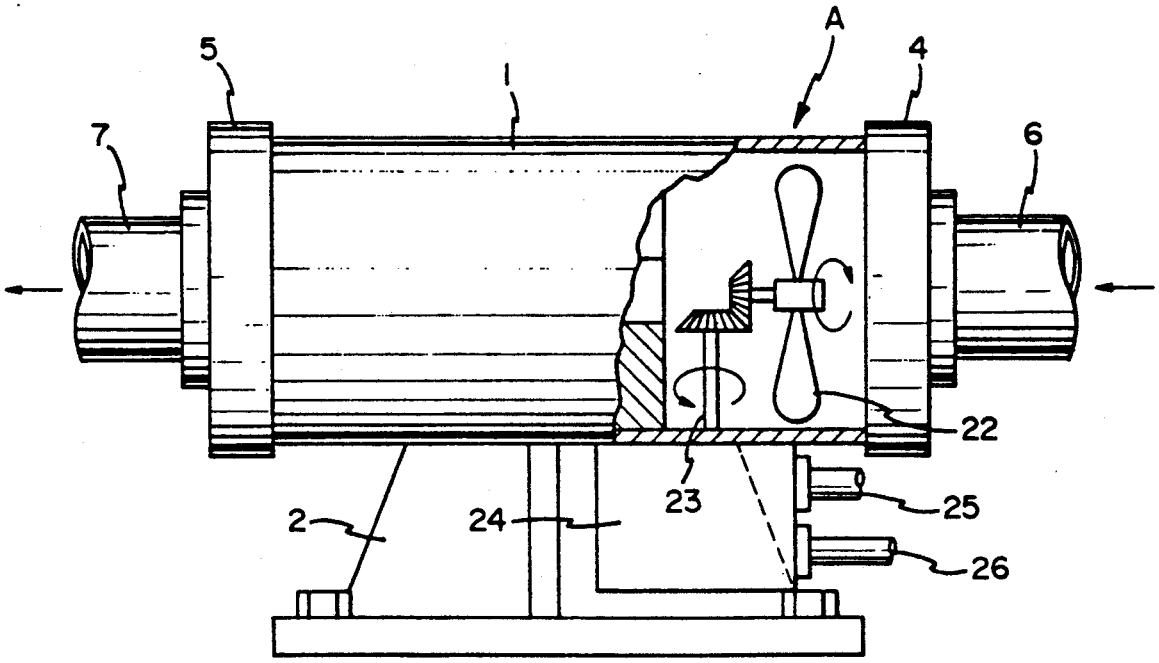
FIG. 5 is a partially sectional view showing the third embodiment of the anticorrosive device.

FIG. 5 shows the third embodiment of the anticorrosive device whose casing 1 further includes a fan 22 which is rotatably supported in front of the low potential metal member 3. The fan 22 is further mechanically connected to a pump 24 through a rotatable shaft 23. The pump 24 is driven as the fan 22 is rotated by the flow of sea water intaken through the connection pipe 6. The pump 24 is provided with an inlet pipe 25 for sucking the water from the bottom of this boat and an outlet pipe 26 for discharging the sucked water out of the boat. The inlet pipe 25 may be further provided with a branch pipe, not shown, which may be connected to the coolant pipe 9 near by the Kingston valve 13. This branch pipe will act in the case of no water in the bottom. According to this third embodiment, the water in the bottom can be automatically discharged out of the boat while the anticorrosive device (A) is operating.

As given explanation above, in the above described anticorrosive device, an anticorrosive current is generated by the potential between the low potential metal member such as zinc installed in the engine cooling system and the portions of the engine electrically connected therebetween, so that the anticorrosive current can prevent the engine from suffering with electrolytic corrosion. On the same occasion, the resolved low potential metal is deposited on the inner surface of the coolant pipe owing to its plating function. According to this operation, the rust can be removed from the surfaces of the engine and the coolant pipe, and then the rust-removed surfaces are coated with the low potential metal layer as a protection layer. This anticorrosive and rust free effects ensure to prolong the lifetime of the marine-using engine. Further, in the case of the anticorrosive unit additionally provided with the charger, current is flowed from the charger to various portions of the engine so that the low potential metal can be accelerately resolved. Therefore the rust can be effectively removed from the inner surface of the coolant pipe and the coating layer can be smoothly deposited thereon. In addition to the anticorrosive effect, the pump is driven by the coolant flow to discharge the sea water collected in the bottom of the boat.

Since the low potential metal member can be set into one place; the casing of the anticorrosive device, the metal member will be gradually resolved for a long period such as several years. This effect removes the necessity of exchanging and checking the low potential metal member within a short period. Even if it should be exchanged, its exchanging work is extremely easy.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An anticorrosion device for engines used in a marine environment, comprising:

(a) a cylindrical casing made of electrically conductive material, said casing being provided with two lids which are detachably fixed on both ends of said casing;

(b) first connection pipe means for connecting one of said lids to a water intake unit of an engine to be protected;

(c) second connection pipe means for connecting the other lid to an engine cooling system of the engine to be protected;

(d) a low potential metal member formed in a hollow cylinder shape with a through hole and a longitudinal slit, being set in the interior of said casing so that sea water drawn from the water intake unit flows through the through hole and the longitudinal slit of said low potential metal members; and (e) means for electrically connecting said cylindrical casing to several portions of the engine body.

2. The anticorrosion device according to claim 1, further comprising:

(a) a charger which is adapted to be electrically connected between a power source and several portions of the engine to accelerate resolution of said low potential metal member.

3. The anticorrosion device according to claim 1, further comprising:

(a) a turbine disposed in a water flow passage of said cylindrical casing; and, (b) a water discharge unit drivingly connected to said turbine.

4. The anticorrosion device according to claim 1, wherein:

(a) said low potential metal member is made of one of zinc and zinc alloy.

5. An anticorrosion device for engines used in a marine environment, comprising:

(a) a cylindrical casing having first and second ends, said cylindrical casing being formed from an electrically conductive material;

(b) first connection pipe means for connecting said first end to a water intake unit of an engine to be protected, (c) second connection pipe means for connecting said second end to an engine cooling system of the engine to be protected; and, (d) a low potential metal member having an opening formed therein, said low potential metal member being disposed in said cylindrical casing so that water drawn from the water intake unit flows through said opening; and, (e) means for electrically connecting said cylindrical casing to at least one portion of the engine.

6. The anticorrosion device according to claim 5, further comprising:

(a) a charging means for accelerating the resolution of said low potential metal member.

7. The anticorrosion device according to claim 5, further comprising:

(a) a turbine disposed in a water flow passage of said cylindrical casing; and, (b) a water discharge unit drivingly connected to said turbine.

8. The anticorrosion device according to claim 5, wherein:

(a) said low potential metal member is made of one of zinc and zinc alloy.

* * * * *